United States Patent [19]

Conrad

[11] Patent Number: 5,031,804

[45] Date of Patent: Jul. 16, 1991

[54] PAINT CAN LID WITH TOP POURING SPOUT

[76] Inventor: Donald A. Conrad, 519 Cerro St., Encinitas, Calif. 92024

[21] Appl. No.: 438,115

[22] Filed: Nov. 20, 1989

[51] Int. Cl.[5] ..... B65D 25/48

[52] U.S. Cl. ..... 222/566; 222/569

[58] Field of Search ..... 222/566–570; 220/85 SP

[56] References Cited

U.S. PATENT DOCUMENTS

| | | | |
|---|---|---|---|
| 2,805,006 | 9/1957 | Henchert | 222/566 |
| 2,819,001 | 1/1958 | Pottle | 222/566 |
| 2,981,449 | 4/1961 | Perkins | 222/570 X |
| 3,231,156 | 1/1966 | Schultz | 222/570 X |
| 3,672,547 | 6/1972 | Kozlowski | 222/567 |
| 4,342,408 | 8/1982 | Boring et al. | 222/566 |
| 4,560,081 | 12/1985 | Adams | 220/85 SP |
| 4,653,669 | 3/1987 | Von Holdt | 222/90 |

FOREIGN PATENT DOCUMENTS

| | | | |
|---|---|---|---|
| 1050613 | 12/1966 | United Kingdom | 222/570 |

*Primary Examiner*—Michael S. Huppert
*Attorney, Agent, or Firm*—John J. Murphey

[57] ABSTRACT

A combination pouring spout and flat lid for attachment to the top of a viscous liquid container, including a short, conically-shaped pouring spout having a narrow diameter upper end and a wider diameter lower end allowing it to pass upward through an aperture formed in the flat lid for fixable engagement therewith, a flange extending outward about the lower end of the spout containing construction for absorbing shock from use of the spout and from extraneous impacts thereagainst, an annular planar mating surface formed on the upper portion of the flange for contact with the underside of the lid, a constricted throat portion formed in the spout having a swollen, ring-shaped portion formed in the spout above the throat of an outside diameter slightly greater than the diameter of the aperture and an upwardly and inwardly slanted outer surface formed about the ring-shaped portion for centering the ring-shaped portion in the aperture to bring the mating surface into contact with the lid and lock the spout firmly in the aperture.

6 Claims, 2 Drawing Sheets

PAINT CAN LID WITH TOP POURING SPOUT

BACKGROUND OF THE INVENTION

1. Field of the Invention

The present invention relates generally to containers and pouring spouts therefor and more specifically to a modification of a lid, for a paint can or container of other viscous liquids and the like, to install a pouring spout therein.

2. Description of the Prior Art

Conventional containers for viscous liquids, such as paints, enamels and the like, usually include a flat top having a circular bead formed around the outer edge thereof for engagement with a circular groove surrounding the upper part of the container. These cans are generally of great diameter and pouring the viscous contents therefrom causes the liquid to spread out over a wide pouring area about the circumference of the container often causing spilling of the contents onto surfaces not intended to be wet with the liquid. In addition, when the container is opened, the whole top of the container becomes exposed to the air allowing dust and dirt to enter into the container and contact the viscous contents therein such that later application of the contents to a surface would show dirt particles and other discontinuities that detract from the quality of the material. Further, continually removing the lid and pouring the paint or other viscous liquid therefrom causes the liquid to build up in the groove of the container to discolor, dry, flake and chip and fall into the liquid remaining in the container.

A number of attempts have been made in the past to provide a narrow pouring spout for attachment to either the container or an aperture formed in the flat lid to confine the liquid pouring from the container into a narrow and more controllable stream. These devices have not come without their own special problems.

For instance, some of the spouts are so large they encompass the whole top of the viscous liquid container and therefore do not confine the contents thereof sufficient to make the stream any more controllable than the fully opened container. Other spouts contain particular attachment features that require the attachment to be made at the factory or to be made to the lid using special equipment that is costly and not always available to the user. Most of the prior art spouts are of metal and difficult to clean.

For paint that is stored in containers already having a spout attached to the lid, the retailer finds he or she cannot stack the containers one on top of another as is usual with cans having flat tops because of the presence of the spout thereby forcing the seller to use a greater portion of floor or storage area than he normally would have with other conventional containers.

Mechanical connections between the spouts and the container lid have been known to work loose thereby allowing the contents to flow through the loosened connections and spill onto floors and other surfaces. Some spouts contain air passageways or other interior piping that clogs with paint and prevents the spout from being later used with other materials—or cannot be easily cleaned so as to allow use with more than one material. Most spouts in the prior art are designed such that they cannot withstand shock loading such as that coming from impacts from other containers that are moved about by the painter or user during normal painting utilization procedures.

Finally, slight dents made in the flat container lid by the accidental dropping of a hammer or bumping of the container, in many cases causes the spout to either be twisted into a non-usable position or to develop a leak, crack or otherwise become useless for confining the flow of the liquids from the container.

SUMMARY OF THE INVENTION

This invention is a novel pouring spout for attachment to the removable flat lid of any viscous liquid container and solves all of the aforesaid problems of the prior art. This novel spout is short and conically shaped to confine the flowing contents to an easily manageable stream. The spout is of smaller diameter than the full container lid thereby allowing the contents to be poured from the container in a narrow, controllable stream. The short spout is free of pipes and tubes so that it is easily cleaned to allow its use on different containers. The spout needs be attached to the container only once, when the contents are to be initially used, so that no paint or other liquid will enter the groove thus eliminating influx of dirt and debris.

Special means are provided in the lid-attachment portion of the spout for absorbing shocks and extraneous impacts against the spout thereby allowing the spout to remain useful in a more active atmosphere. A self-centering ring is formed on the outer portion of the spout for assisting in aligning the spout within the performed aperture for centering therein and pressing the spout into fluid-sealing contact with the lid. A mating surface is formed on a portion of the spout to contact the lid, with or without the use of adhesives, to form a strong leak-proof bond therebetween. A threaded cap is provided at upper end of the spout for closing over the spout when not in use.

The spout of this invention comprises a conically-shaped pouring spout of terminal length, made of slightly yieldable material such as plastic that has been fluorine gas-treated to make it impervious to oil-based solvents. It has a narrow outside diameter thereby allowing it to pass upward through a pre-formed aperture formed in the lid for fixed engagement with the lid, an outwardly directed flange of a diameter greater than the aperture, g formed at the lower end of the spout and containing means such as a sinusoidal curve portion for absorbing shock and extraneOus impacts against the spout from outside. An annular mating surface is formed on the upper portion of the flange for contact with the underside of the lid, a constricted throat portion is formed in the spout opposite the mating surface of an outside diameter slightly less than the diameter of the aperture in conjunction with a swollen, ring-shaped portion, formed in the spout above the throat, of an outside diameter slightly greater than the diameter of the aperture to allow for centering the spout in the aperture and thereafter interlocking it in engagement with the lid.

Accordingly, the main object of this invention is a combination of a strong pouring spout attached to a flat lid of a conventional viscous liquid container for use in controlling the flow of liquid from the container that is easy to use and to clean so that it may be easily reused on another container of liquid. Other objects include a spout that contains shock-absorbing qualities to allow it to be used in the face of extraneous impacts and shocks delivered from the outside, that allow it to be easily and quickly attached to the lid of any conventional liquid container wherein a ring-shaped, self-centering feature is provided in the lower part of the spout for use in allowing easy connection between the spout and the can lid. These and other objects of the invention will become more apparent by a reading of the following description of the preferred embodiment taken in light of the drawings attached hereto. The scope of protection sought by the inventor may be gleaned from a fair reading of the claims that conclude this specification.

DESCRIPTION OF THE PREFERRED EMBODIMENT

Figure 1:
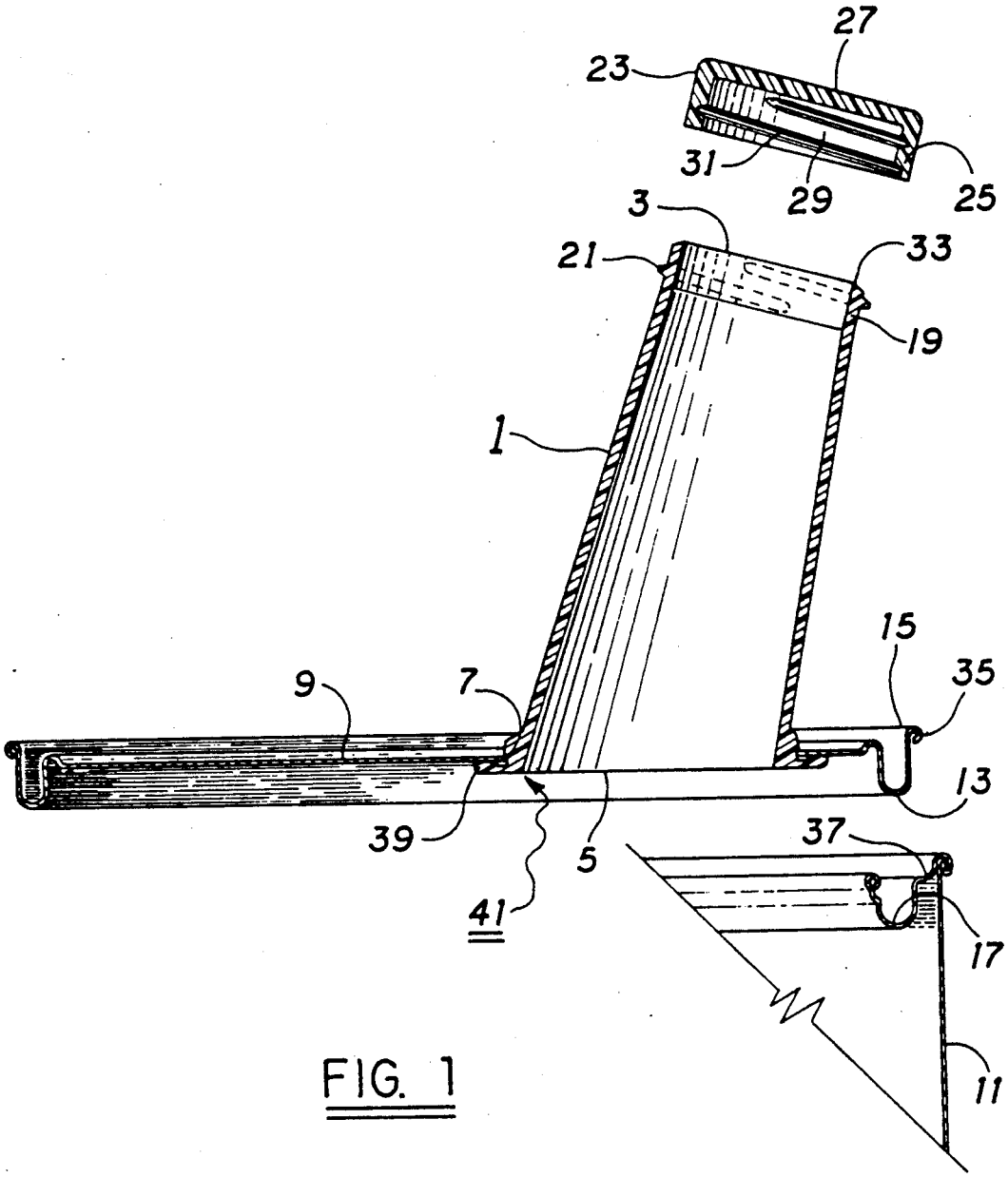
FIG. 1 is a side elevational sectional view of the preferred embodiment of this invention showing its use in a typical container for holding viscous liquids.

Shown in FIG. 1 is the pouring spout of this invention and it is shown to comprise a short, conically-shaped pouring spout 1 of terminal length having a narrow diameter upper end 3 and a wider diameter lower end 5 thereby allowing it to pass upward through an aperture 7 formed in a flat lid 9 normally used with containers 11 for holding paint or other viscous liquids.

Flat lid 9 is of the type having a circular bead 13 depending about the outer edge 15 adapted for engagement with a circular groove 17 surrounding the upper part of container 11.

Preferably, upper spout end 3 contains a short cylindrical section 19 including threads 21 formed externally and circularly thereabout for receipt thereover of an end cap 23 that comprises a short cylindrical section 25 closed over at its upper end by wall 27 and having an open portion 29 adapted for slipping over cylindrical section 19 and having formed therein internal circular threads 31 for engaging external threads 21 to seal off spout 1. Further, the upper terminal end 3 of spout is preferably characterized by a sharp edge 33 formed thereabout to aid in reducing dripping of the liquid as it is poured from spout 1.

Spout 1 is preferably made from a yieldable plastic such as polyvinylchloride or polyethylene that may be blow molded to the appropriate shape and thereafter treated with an oxidizing vapor such as fluorine gas to make it impervious to attack from oil-based solvent paints and other solvent-based liquids.

Lid 9 terminates at its outer point in a thickened edge 35 that, when circular bead 13 is pressed down into circular groove 17 resides in a depression 37 formed outboard of groove 17. Thickened edge 35 is adaptable to be pried upward by a screwdriver or other flat blade to remove bead 13 from groove 17 to lift lid 9 off container 11.

Flange 39 extends outward from lower spout end 5 and contains means 41 for absorbing shock from extraneous impacts brought against spout 1 from outside such as from bumps of other paint cans during use in normal painting and other such activities. Means 41 is better shown in FIG. 2 to comprise a sinusoidal curved portion 43 of flange 39 that will flex when spout 1 is struck from the side so as to relieve the stress on spout 1 and allow its continued connection integral with lid 9.

An annular, planar mating surface 45 is shown formed on one portion of the upper surface 47 of flange 39, in spaced-apart relation from spout 1 and adapted for contact with the underside of lid 9. Preferably, a small layer 49 of adhesive is placed on mating surface 45 to insure a tight and long-lasting, fluid proof bond between flange 39 and lid 9. A wide variety of contact adhesives compatible with the plastic making up flange 1 and the metal making up lid 9 are available for this purpose and are already known in the art.

Figure 2:
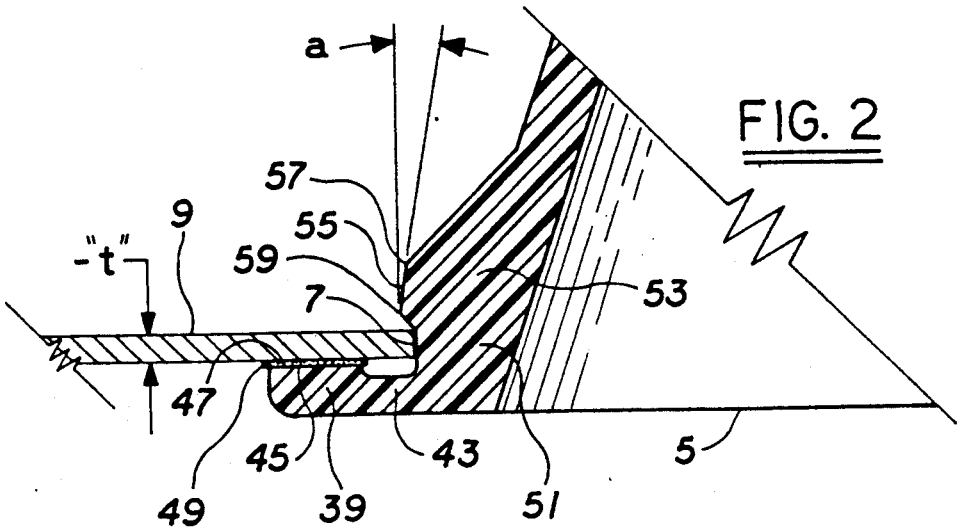
FIG. 2 is a side sectional close-up view of a portion of the spout shown in FIG. 1, showing further detail of the connection portion therebetween; and, FIG. 3 is a partial top elevational view of a typical container lid mounted in a can showing the die-stamped area of the aperture that may be removed for use in mounting the pouring spout of this invention.

A constricted throat portion 51 is formed on lower spout end 5 opposite to or spaced inward from mating surface 45 of an outside diameter slightly less (i.e., a few thousandths of an inch less) than the diameter of aperture 7 to allow said throat portion 51 to pass through aperture 7 as spout 1 is passed upward through lid 9. A swollen, ring-shaped portion 53 is formed in spout 1 spaced above throat portion 51 on which is formed an upwardly and inwardly slanted outer surface 55. Slanted surface 55 is terminated at an upper circular edge 57 of a diameter slightly less than (a few thousandths of an inch less) the diameter of lid aperture 7. Slanted surface 55 is terminated at a lower circular edge 59 that is slightly greater (a few thousandths of an inch greater) in diameter than the diameter of aperture 7. Lower circular edge 59 is spaced adjacent constricted throat portion 51 and above flange mating surface 45 a distance slightly greater than (a few thousandths of an inch greater) the thickness "t" of lid 9 as shown in FIG. 2. Slanted surface 55, terminated at upper edge 57 and lower edge 59 forms an angle "a" with the vertical from lower circular edge 59 by approximately 10°–20° to allow spout 1 to be self-centered in lid aperture 7 and thereafter pressed upward so that spout 1 must flex to allow lower circular edge 59 to pass upward through smaller aperture 7 and thereafter snap outward to hold lid 9 between lower circular edge 59 and mating surface 45 of flange 39. Such a construction permits spout 1 to be easily and quickly passed upward through aperture 7 and snapped into place to allow the combination of spout 1 and lid 9 to be thereafter placed over the opened top of container 11.

Figure 3:
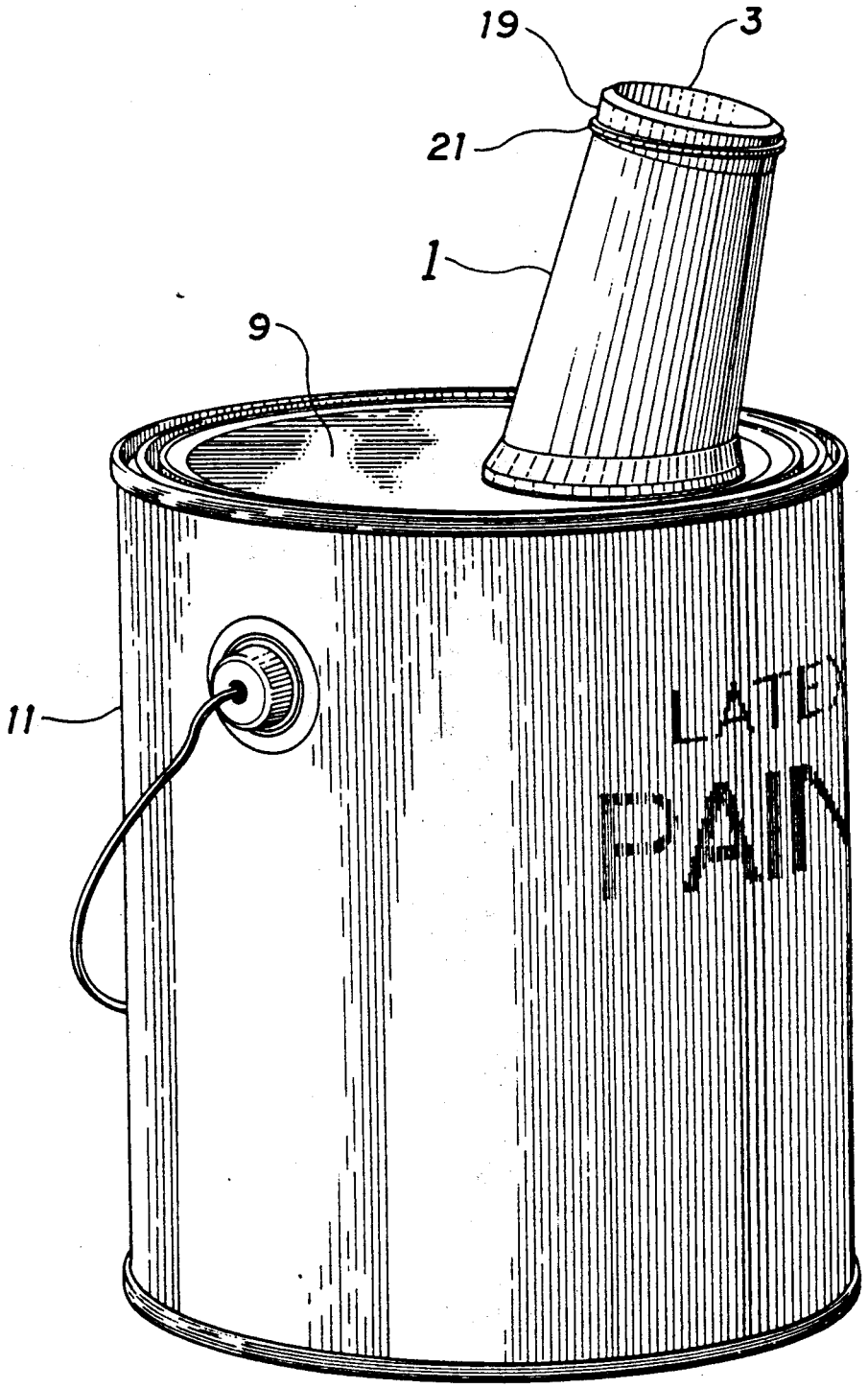

FIG. 3 shows how spout 1 is preferably slanted toward circular bead 13 so as to permit easy pouring of the contents without having to tip over container 11 too far.

What is claimed is:

1. A combination pouring spout and flat lid for attachment to the top of a viscous liquid container, comprising:

(a) a short, conically-shaped pouring spout, of terminal length, made of a slightly yieldable material, having a narrow diameter upper end and a wider diameter lower end allowing it to pass upward through an aperture formed in the flat lid for fixable engagement therewith;

(b) a flange extending outward about said lower end of said spout containing means for absorbing shock from use of said spout and from extraneous impacts thereagainst, said means including a sinusoidal-shaped curved portion formed in said spout between said ringshaped portion and said mating surface;

(c) an annular planar mating surface formed on the upper portion of said flange for contact with the underside of the flat lid;

(d) a constricted throat portion formed in said spout opposite said mating surface of an outside diameter slightly less than the diameter of said aperture;

(e) a swollen, ring-shaped portion formed in said spout above said throat of an outside diameter slightly greater than the diameter of said aperture, said swollen portion spaced above said mating surface a distance of at least the thickness of the lid; and, (f) an upwardly and inwardly slanted outer surface formed about said swollen, ring-shaped portion for centering said portion in said aperture and for yieldingly passing therethrough to bring said mating surface into contact with said lid and lock said spout firmly in said aperture.

2. The pouring spout of claim 1 further including a layer of adhesive deposited on said mating surface for adhering said surface to the underside of said lid.

3. The pouring spout of claim 1 further including threads formed externally about said upper end of said spout and an external cap for placement thereover having internal threads formed therein for engaging said external threads to seal off said spout.

4. The pouring spout of claim 1 wherein said aperture is circular.

5. The pouring spout of claim 1 wherein said spout is inclined with respect to the lid on which it is mounted.

6. The pouring spout of claim 1 wherein said spout is made of yieldable plastic treated with fluorine gas to make it resistant to attack from solvent-based liquids.

* * * * *